US005357330A

United States Patent [19]

Hauser

[11] Patent Number: 5,357,330

[45] Date of Patent: Oct. 18, 1994

[54] MULTILAYER TONER TRANSFER ORDERING

[75] Inventor: Oscar G. Hauser, Rochester, N.Y.

[73] Assignee: Xerox Corporation, Stamford, Conn.

[21] Appl. No.: 974,541

[22] Filed: Nov. 12, 1992

[51] Int. Cl.[5] ..... G03G 15/16

[52] U.S. Cl. ..... 355/326 R; 355/274; 355/273; 430/45

[58] Field of Search ..... 430/43, 44, 45; 355/326, 327, 273, 274, 275, 272; 346/157

[56] References Cited

U.S. PATENT DOCUMENTS

| | | | |
|---|---|---|---|
| 3,862,848 | 1/1975 | Marley | 117/37 LE |
| 3,893,761 | 7/1975 | Buchan et al. | 355/272 |
| 3,957,367 | 5/1976 | Goel | 355/271 |
| 4,188,213 | 2/1980 | Lehman | 430/45 X |
| 4,236,809 | 12/1980 | Kermisch | 346/157 |
| 4,660,059 | 4/1987 | O'Brien | 346/157 |
| 4,682,880 | 7/1987 | Fujii et al. | 355/327 |
| 4,819,028 | 4/1989 | Abe | 355/326 |
| 4,833,503 | 5/1989 | Snelling | 355/259 |
| 4,987,455 | 1/1991 | Lubberts | 355/326 X |
| 5,038,171 | 8/1991 | Fujiwara et al. | 355/326 X |

FOREIGN PATENT DOCUMENTS

| | | | |
|---|---|---|---|
| 0453762 | 10/1991 | European Pat. Off. | G03G 15/16 |
| 32855 | 2/1986 | Japan | 355/326 |

OTHER PUBLICATIONS

Xerox Disclosure Journal, "Color Xerography With Intermediate Transfer"; J. R. Davidson; vol. 1, No. 7, Jul. 1976; p. 29.

*Primary Examiner*—Benjamin R. Fuller
*Assistant Examiner*—John Barlow
*Attorney, Agent, or Firm*—Mark Costello

[57] ABSTRACT

In an electrophotographic imaging device, in which an electrostatic image is formed and developed on a first support to form a toned image, and the toned image is transferred to a second support substrate and subsequently to a final support, and in which to form color images, a succession of toner images are superposed on each other by transfer from one or more first support to the second support, transfer efficiency is enhanced and color consistency is improved by providing an order of superposition which places the toner having the greatest residual mass/area dependent color instability in a position of being sandwiched between or protected by two or more other toner images whose color contribution to gray balance is not as greatly dependent on mass per unit area. Thus, during transfer, the sandwiched or middle layer(s) will retain integrity.

10 Claims, 4 Drawing Sheets

MULTILAYER TONER TRANSFER ORDERING

The present invention is directed to an electrophotographic device with an intermediate transfer belt, and more particularly, to the deposit of colored toner in an order selected to maintain stable gray balance therein, based on toner properties.

BACKGROUND OF THE INVENTION

A primary problem associated with electrophotographic device reproduction of color is reproducibility. Users of such devices expect stability in color rendition within a page, from page to page, and from job to job. One method of maintaining color reproducibility with process colorants is to achieve stable gray balance.

Imaging processes wherein a developed image is first transferred to an intermediate transfer support and subsequently transferred from the intermediate transfer support to a support are known. For example, U.S. Pat. No. A 3,862,848 (Marley), discloses an electrostatic method for the reproduction of printed matter in which an electrostatic latent image is developed by the attraction of electroscopic marking particles thereto and is then transferred to a first receptor surface by the simultaneous application of contact and a directional electrostatic field of a polarity to urge the marking particles to the receptor surface, with the image then being transferred from the first receptor surface to a second receptor surface by the simultaneous application of contact and a directional electrostatic field of opposite polarity to urge the marking particles to the second receptor surface.

A primary problem associated with such intermediate transfer arrangements is that upon the electrostatic transfer of toner from a first support to a second, i.e., from photoreceptor to intermediate, photoreceptor to paper, or intermediate to paper, some residual amount of toner is always left on the first support. In color applications, having three or four layers of toner, this suggests that the layer of toner on the first support farthest from the second support will have some residual amount of toner left on the first surface, i.e., transfer efficiency of this layer is less than 100%. If the amount of this residual is known prior to imaging and is stable within a page, from page to page, and from job to job, then a precompensation process can be put into place to maintain gray balance. However, if there is instability in the residual amount, or if it is a function of image content or location, then the best that may be done is to alleviate the impact of instability.

U.S. Pat. No. A 3,957,367 to Goel, discloses an example color electrostatographic printing machine in which successive single color powder images are transferred, in superimposed registration with one another, to an intermediary. The multi layered powder image is fused on the intermediary and transferred therefrom in a single step to a sheet of support material, forming a copy of the original document.

U.S. Pat. No. A 3,893,761 to Buchan et al., discloses an apparatus for transferring non fused xerographic toner images from a first support material, such as a photoconductive insulating surface, to a second support material, such as paper, and fusing the toner images to the second support material. Toner images are transferred from the first support material to the intermediate transfer member by any conventional method, preferably pressure transfer. The toner image is then heated on the intermediate transfer member to at least its melting point temperature, with heating preferably being selective. After the toner is heated, the second support material is brought into pressure contact with the hot toner whereby the toner is transferred and fused to the second support material.

U.S. Pat. No. A 4,682,880 (Fujii et al.), discloses a process wherein an electrostatic latent image is formed on a rotatable latent image bearing member and is developed with a developer into a first visualized image. The first visualized image is transferred by pressure to a rotatable visualized image bearing member. The steps are repeated with different color developers to form subsequent visualized images on the same visualized image bearing member to constitute a multi color image which corresponds to one final image to be recorded. The latent image bearing member and the visualized image bearing member form a nip therebetween through which a recording material is passed so that the multi color image is transferred all at once to a recording material.

"Color Xerography With Intermediate Transfer," J. R. Davidson, Xerox Disclosure Journal, Volume 1, Number 7, page 29 (July 1976), the disclosure of which is incorporated herein by reference, discloses a xerographic development apparatus for producing color images. Registration of the component colors is improved by the use of a dimensionally stable intermediate transfer member. Component colors such as cyan, yellow, magenta, and black are synchronously developed onto xerographic drums and transferred in registration onto the dimensionally stable intermediate transfer member. The composite color image is then transferred to a receiving surface such as paper. The intermediate transfer member is held in registration at the transfer station for transferring images from the xerographic drums to the member by a hole-and-sprocket arrangement, wherein sprockets on the edges of the drums engage holes in the edge of the intermediate transfer member.

EP-A Publication No. 0 453 762 (A2) discloses an imaging apparatus and process wherein an electrostatic latent image is formed on an imaging member and developed with a toner, followed by transfer of the developed image to an intermediate transfer element and subsequent transfer with very high transfer efficiency of the developed image from the intermediate transfer element to a permanent support.

Intermediate transfer elements employed in imaging apparatuses in which a developed image is first transferred from the imaging member to the intermediate and then transferred from the intermediate to a final support should exhibit both good transfer of toner material from the imaging member to the intermediate and very good transfer of toner material from the intermediate to the support. Very good transfer occurs when most or all of the toner material comprising the image is transferred and little residual toner remains on the surface from which the image was transferred. In order for transfer to be very good, it also has to have a very low variability in the residual toner from job to job, image to image, point to point. Very good transfer is particularly important when the imaging process entails generating full color images by sequentially generating and developing images in each primary color in succession, and superimposing the primary color images onto each other on the intermediate. Undesirable shifting or color deterioration in the final colors obtained can occur when there is variability in the primary color image transfer from the intermediate to the support (paper).

Although known methods and materials are suitable for their intended purposes, a need remains for imaging apparatuses and methods employing intermediate transfer elements with high transfer efficiency to a final support. In addition, there is a need for imaging apparatuses and methods employing intermediate transfer elements that enable generation of full color images with high color image quality and stable color reproduction. Stable color reproduction is associated with maintenance of gray balance during transfer.

One of the characteristics of intermediate transfer (i.e., transfer from a photoreceptor to an intermediate and subsequent retransfer to a final support) is that the top layer during the first transfer becomes the bottom layer during the second transfer, It has been observed that the bottom layer (i.e., the layer closest to the first support and furthest from the second support) generally tends to leave the greatest and most variable amount of residual toner on the support. Accordingly, the contribution to the appearance of an image by this toner is variably affected, especially if the image consists of at least three toner layers.

U.S. Pat. No. A 4,833,503 to Snelling U.S. Pat. No. A 4,819,028 to Abe and U.S. Pat. No. A 4,660,059 to O'-Brien, all disclose methods of forming and developing multiple layers of toner on a surface for subsequent simultaneous transfer to a final support or receiving member. While, strictly speaking, there is no transfer from an intermediate to a final support in the described arrangements, these arrangements and the previously described tandem engine arrangements require a simultaneous transfer of multiple layers of toner, from a first support to a second which tends to leave a residual primarily composed of toner from the layer closest to the first support.

SUMMARY OF THE INVENTION

In accordance with the invention, improved gray balance and color image stability is obtained in an electrophotographic device provided with multi layer toner image formation and simultaneous transfer by careful control of toner deposition therein, based on toner contribution to a final color image.

In an electrophotographic imaging device, in which an electrostatic image is formed and developed on a first support to form a toned image, and the toned image is transferred to a second support and subsequently to a final support, and in which to form color images, a succession of toner images are superposed on each other by transfer from one or more first supports to the second support, and in which the toner layer next to the intermediate belt is the most variable, enhanced color consistency is improved by providing an order of superposition which places the toner having the greatest residual mass/area dependent color instability in a position of being sandwiched between or protected by two or more other toner images whose color contribution to gray balance is not as greatly dependent on mass per unit area. Thus, during transfer, the sandwiched or middle layer(s) will retain integrity.

Noting the characteristic of multi layer transfer, that the bottom layer (i.e., the layer closest to the first support and furthest from the second support) tends to leave the greatest amount of variable residual toner on the support, judicious ordering of the toner images based on the residual toner mass/area dependent color instability is desired. Accordingly, the layer whose residual mass/area dependent color instability has the greatest effect on the output image, is placed in deposition sequence which will cause it to be a middle layer in a multi layer, multi transfer system. The variability in residual after transfer will least affect this layer. As used herein, the effect on the output image is measured in terms of color change of a fused layer of toner per unit of variability in mass deposition on the support material.

Therefore, in accordance with one aspect of the invention, there is provided an electrophotographic imaging apparatus for forming multicolor toner images, comprising: at least first, second and third means each producing a single color toner image each with a distinct colored toner on respective image supporting surfaces of first, second and third image receiving members; means for transferring each toner image from the image receiving members onto an intermediate image receiving member, the toner image from the first toner image producing means deposited directly on the intermediate image receiving member, and the toner from the second and third toner image producing means successively deposited superposed upon the previous toner image to form a multi layer toner image on the intermediate; the second toner image producing means provided with a selected colored toner, variations in mass per unit area of which cause the most significant color shift in an image on a final support of the three colored toners; and means for transferring the multi layer toner image from the intermediate image receiving member to a final support, the transfer characterized by leaving a residual amount of toner of the first toner image on the image receiving member, and the third toner image on the intermediate image receiving member.

In accordance with another aspect of the invention, there is provided electrophotographic imaging apparatus for forming multicolor toner images, comprising: first, second and third means for successively forming latent images in registration on a surface of an imaging member; first, second and third means for developing each latent image with a single color toner, the developing means respectively functionally arranged between the first and second latent image forming means, between the second and third latent image forming means, and after the third latent image forming means, the colored toner from the first developing means deposited directly on the surface of the imaging member, and the toner from the second and third developing means successively deposited superposed upon the previous toner image to form a multi layer toner image; the second toner developing means provided with a selected colored toner, variations in mass per unit area of which cause the most significant color shift in an image on a final support of the three colored toners; and means for transferring the multi layer toner image from the imaging member to a final support, the transfer characterized by leaving a residual amount of toner of the first toner image on the image member. It may be appreciated that an order of deposition may be controlled by repeated circulation of the image bearing member or intermediate past the toner depositing devices, to accomplish ordered toner deposit.

These and other aspects of the invention will become apparent from the following descriptions to illustrate a preferred embodiment of the invention read in con,on with the accompanying drawings in which.

Figure 1:
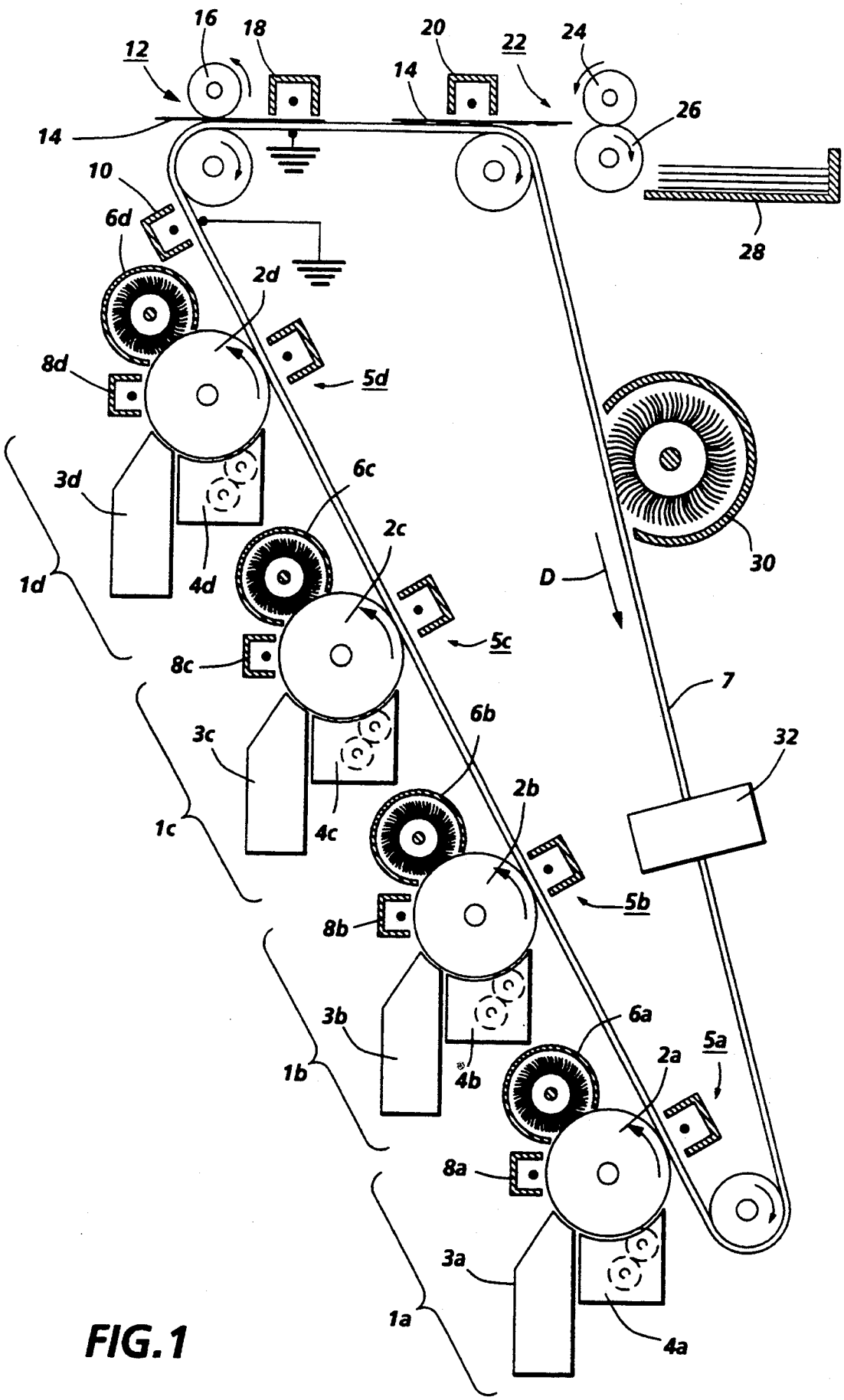
FIG. 1 is schematic illustration of a color printing apparatus in which the present invention may find applicability.

Referring now to the drawings where the showings are for the purpose of describing an embodiment of the invention and not for limiting same, a multi color printer using an intermediate belt, in which the present invention finds use, is shown in FIG. 1.

In dry electrophotographic printing machines, multicolor copying has been achieved with the utilization of an intermediate belt or roller. In devices of this type, successive toner powder images are transferred, in superimposed registration with one another, from the photoconductive drum to an intermediate roller. One such system is described in U.S. Pat. No. A 3,957,367 to Goel, which is herein incorporated by reference. In this system, successive toner powder images are transferred from a photoconductive surface to an intermediate roller in superimposed registration with one another. The multicolored image is then transferred to the copy sheet.

In the color electrophotographic apparatus of the present invention, as shown in FIG. 1, four image forming devices 1*a*, 1*b*, 1*c* and 1*d* are utilized. The image forming devices each comprise an image receiving member in the form of photosensitive drum or photoreceptor 2*a*, 2*b*, 2*c*, or 2*d*, about which are positioned the image forming components of the imaging structure. The image receiving members are supported for rotation in the direction of the arrows as shown. The image forming devices further comprise exposure structures 3*a*, 3*b*, 3*c* and 3*d*, developing structures 4*a*, 4*b*, 4*c* and 4*d*, transfer structures 5*a*, 5*b*, 5*c* and 5*d*, cleaning structures 6*a*, 6*b*, 6*c* and 6*d*, and finally charging structures 8*a*, 8*b*, 8*c* and 8*d*. An intermediate image receiver 7, such as an endless belt, is supported for movement in an endless path such that incremental portions thereof move past the image forming devices 1*a*, 1*b*, 1*c* and 1*d* for transfer of an image from each of the image receiving members 2*a*, 2*b*, 2*c* and 2*d*. Each image forming device 1*a* through 1*d* is positioned adjacent intermediate belt 7 for enabling transfer of different color toner images to intermediate belt 7 in superimposed registration with one another. Belt 7 may be fabricated from clear Tedlar TM (Trademark of E.I. dupont de Nemours & Co. for a polyvinylfluoride film) or carbon loaded Tedlar or pigmented Tedlar. Other dielectric belt materials may be used.

Exposure structures 3*a* through 3*d* may be any type of raster output scanning device (ROS). One possible embodiment uses a two-level ROS device incorporating a laser. The ROS is a moving spot system that exposes the photoreceptors 2*a* through 2*d* to a light intensity at two levels. Generally, a laser is the light source producing a collimated light beam suited for focusing to a small spot, with adequate energy to effectively discharge the photoconductors 2*a* through 2*d* which have been previously uniformly charged using the charging structures 8*a* through 8*d*. Charging structures 8*a* through 8*d* may comprise conventional corona discharge devices. The sweep or moving action of the spot is typically obtained by rotating multifaceted mirrors or by reciprocating mirrors attached to galvanometers. An example of a ROS mechanism includes U.S. Pat. No. A 4,236,809 (Kermisch), herein incorporated by reference. Other methods of forming a latent image on a surface are known, including numerous types and methods of illuminating a photoconductive surface, and ionographic devices, which directly deposit a charge on a surface in imagewise configuration.

Belt 7 moves in a direction illustrated by arrow D such that each incremental portion thereof first moves past the imaging forming device la. A first toner image component corresponding to a first color toner component of an original is formed on the photosensitive drum 2*a* using conventional electrophotographic components such as the charging structure 8*a*, the exposure structure 3*a* and the developing structure 4*a*. The developer structure develops a first color toner image on the photosensitive drum 2*a*. The drum rotates in the counterclockwise direction and contacts the belt 7 as shown. The transfer structure 5*a* which may comprise a corona discharge device serves to effect transfer of the first color toner component of the image at the area of contact between the photosensitive member 2*a* and the belt 7. Subsequent to transfer of the first color toner image to the belt 7, residual first color toner is removed from the drum 2*a* using the cleaning structure 6*a*.

In like fashion, a second color toner image component corresponding to the second color component of the original image is formed on the photosensitive drum 2*b* using conventional electrophotographic components such as the charging structure 8*b*, the exposure structure 3*b* and the developing structure 4*b*. The developer structure develops a second color toner image on the photosensitive drum 2*b*. The drum rotates in the counterclockwise direction and contacts the belt 7 as shown. The transfer structure 5*b*, which may comprise a corona discharge device, serves to effect transfer of the second color component of the image at the area of contact between the photosensitive member 2*b* and the belt 7. Subsequent transfer of the second color image to the belt 7, residual second color toner is removed from the drum 2*b* using the cleaning structure 6*b*.

The third and fourth image components corresponding, respectively to the third and fourth color components of the original are formed on the photosensitive drums 2*c* and 2*d*, respectively. These images are sequentially transferred to the belt 7 in a superimposed relationship resulting in a final toner image comprising three colors plus black. Corona discharge devices 5*c* and 5*d* were used for image transfer. After transfer of the third and fourth color component images, residual toner is removed from the respective image receiving members by cleaning structures 6*c* and 6*d*.

In one possible embodiment, a composite toner image on the belt 7 is treated prior to transfer using a DC corona discharge device 10. This pretreatment serves to greatly reduce the wrong sign toner and shifts the average charge of the toner to make it more negative thereby enabling highly efficient transfer.

Subsequent to corona pretreatment, the intermediate belt 7 is moved through a transfer station 12, where the multicolored image is transferred to a sheet of transfer material or copy sheet 14. A sheet of transfer material 14 is moved into contact with the toner image at transfer station 12. The sheet 14 is advanced to the transfer station 12 by conventional sheet feeding apparatus, not shown. Preferably, sheet feeding apparatus includes a feed roll contacting the uppermost sheet of a stack of copy sheets. Feed rollers rotate so as to advance the uppermost sheet from the stack into contact with intermediate belt 7 in a timed sequence so that the toner powder image thereon contacts the advancing sheet at the transfer station 12. At transfer station 12, a biased transfer roll (BTR) 16 is used to provide good contact and an electric field between the sheet 14 and the toner image during transfer. A corona transfer device 18 is also provided for assisting the BTR in effecting image transfer. A detack corona device 20 is provided downstream of the corona device 16 for facilitating removal of the sheet 14 from the belt 7.

The sheet 14 carrying the transferred toner image is passed through the nip of a heat and pressure fuser 22. The fuser 22 comprises a heated fuser roller 24 and a backup roller 26. Sheet 14 passes between fuser roller 24 and backup roller 26 with the toner powder image contacting fuser roller 24. In this manner, the toner powder image is permanently affixed to sheet 14. After fusing, a chute, not shown, guides the advancing sheet 14 to a catch tray 28 for subsequent removal from the printing machine by the operator.

After the sheet of support material 14 is separated from belt 7, the residual toner particles on the surface of the belt are removed therefrom. These particles are removed by a cleaning apparatus 30. Subsequent to cleaning, discharge device 32 is used to neutralize any residual electrostatic charge remaining on the belt 7 prior to the next imaging cycle.

Figure 2:
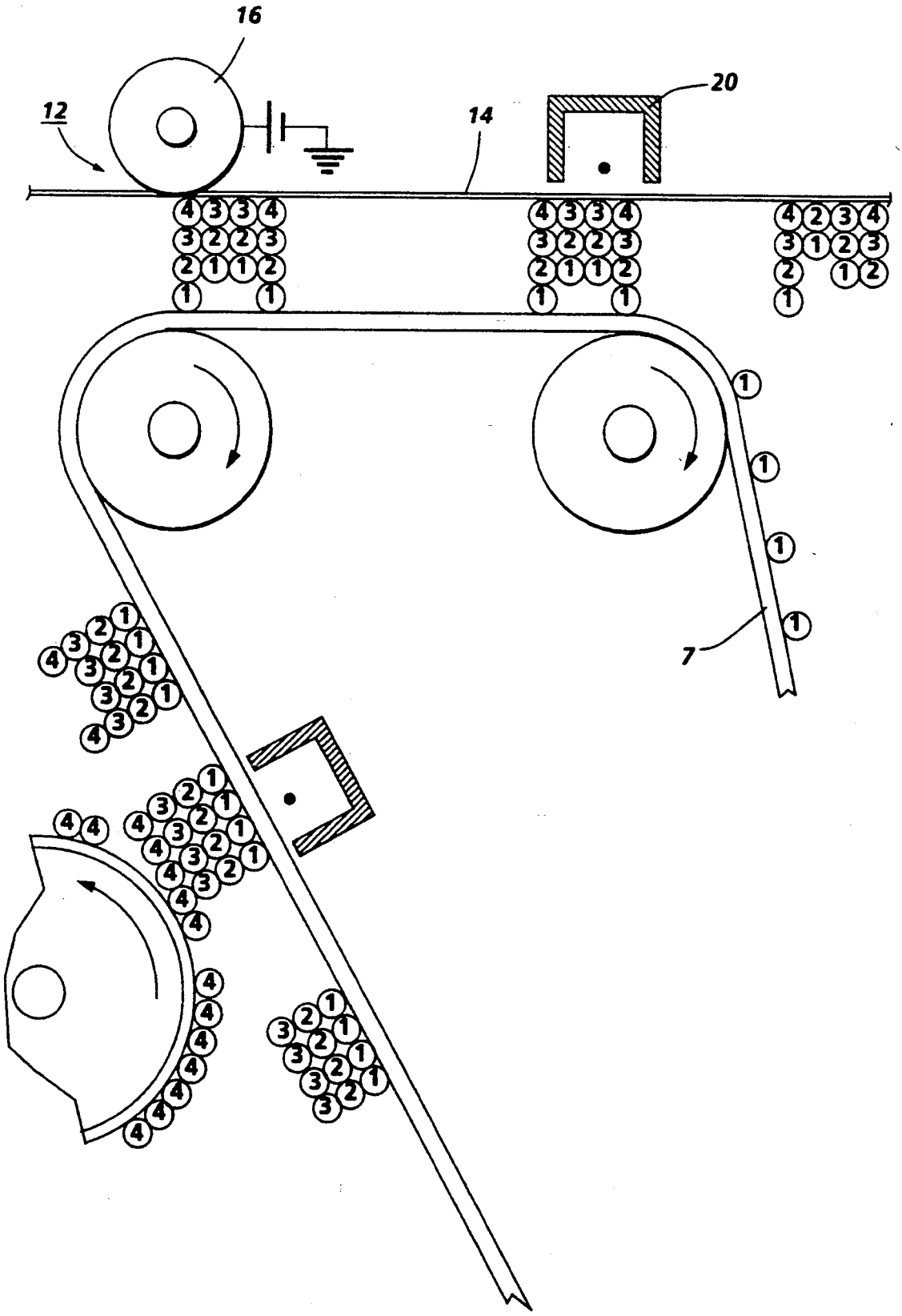
FIG. 2 is an enlarged view of the transfer regions showing the relative positions of toner layers before transfer from first to second supports, and second to final supports.

In accordance with the invention, and with reference now to FIG. 2, an enlarged view of the system is shown. Assume for a moment that toners 1, 2 and 3 have been previously deposited on intermediate belt 7. In registration with the image, toner 4, imagewise developed onto photoreceptor **2*d*, is transferred to belt 7, where it overlays previously deposited toner layers of toners 1, 2 and 3. Subsequently, the four toner image is transferred to a final support, such as a sheet 14. As illustrated, however, some portion of toner layer 1 remains as residual on intermediate belt 7. This tends to change the color of the image from what it would have been if all of toner layer 1** had been transferred.

Figure 3:
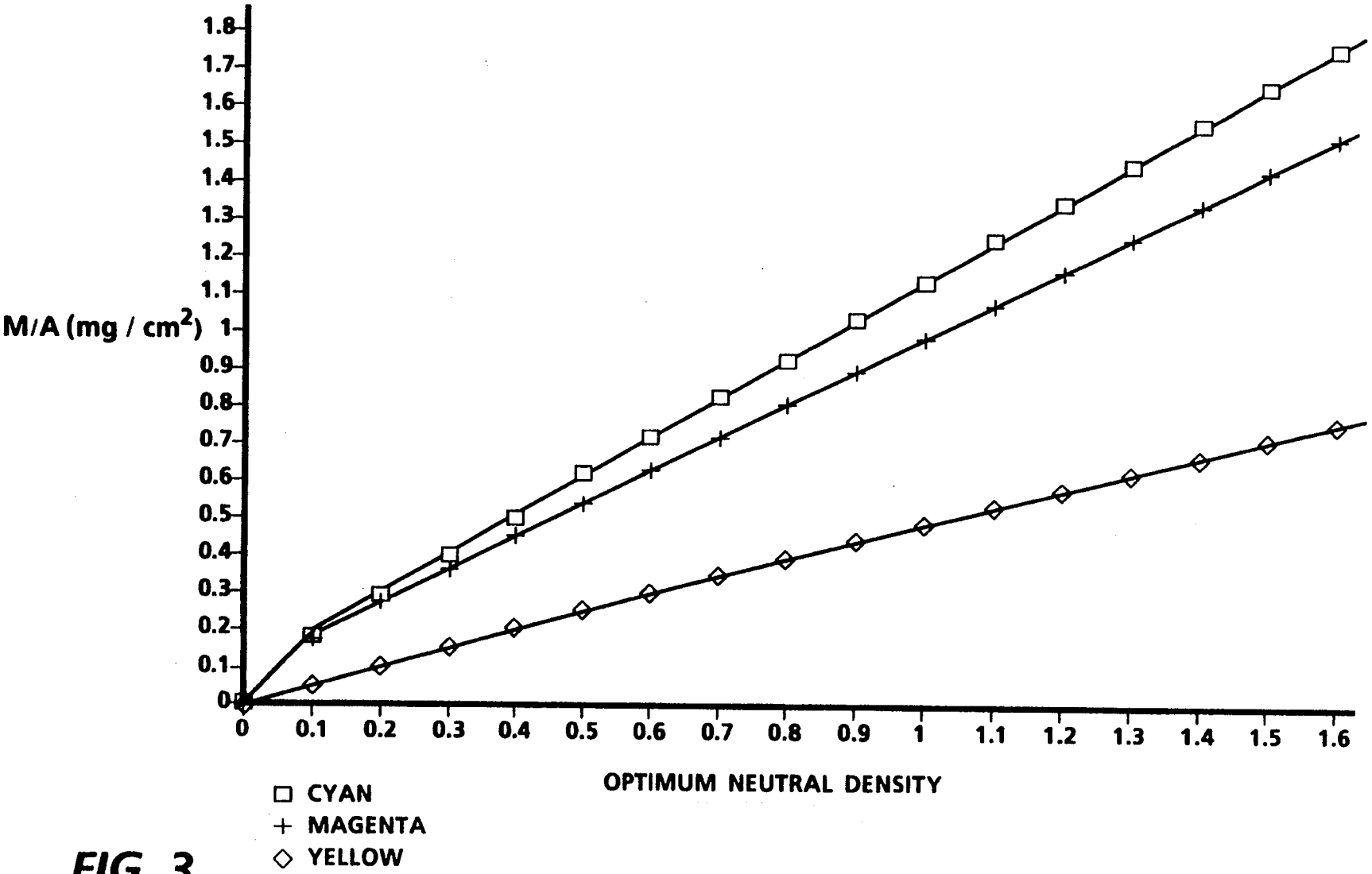
FIG. 3 shows a plot of relative toner densities required for production of neutral density grays.

In one such color device, a neutral density gray was obtained by combining cyan, magenta and yellow toners in proportions of 0.5 mg/cm$^2$ yellow toner, 1.0 mg/cm$^2$ magenta and 1.15 mg/cm$^2$ cyan toner. In an ideal CMY color system, equal amounts of cyan, magenta and yellow would form neutral gray. However, in practice, variations in the light absorption of each toner require unequal amounts of each toner to create the desired neutral gray. The exact ratio is usually determined empirically for a number of gray densities, and interpolation is used for derived grays between the measured points. In the described example, an absolute amount of reduction in yellow toner would have a significant color change impact on an image, since relatively smaller quantities of yellow are required for neutral density gray. FIG. 3 shows a chart of neutral density grays obtainable for one sample set of magenta, yellow and cyan toners.

Another way of expressing the same function is that, if equal amounts of the above toner (for example, 0.250 mg/cm$^2$ for each of the three colors) are deposited on a white support, the variability of color in units of L*a*b* color space is measured as 1.5 time higher per mg/cm$^2$ for yellow than the other two primaries, or where the equations show the variability of color units (δE) with respect to $$\left.\frac{\delta E}{\delta(^{m}/_{a})_{yellow}}\right)_{cyan,magenta} = 156\ (^{mg}/_{cm2})^{-1}$$

$$\left.\frac{\delta E}{\delta(^{m}/_{a})_{cyan}}\right)_{yellow,magenta} = 90\ (^{mg}/_{cm2})^{-1}$$

$$\left.\frac{\delta E}{\delta(^{m}/_{a})_{magenta}}\right)_{yellow,cyan} = 100\ (^{mg}/_{cm2})^{-1}$$

The variability in color units of the amount of yellow toner ($\delta m/_a$ yellow) when the amount of cyan and magenta toners are held constant is 156 color units per mg/cm$^2$ of yellow toner, while the variability in color units (δE) with respect to the variability of the amount of cyan toner ($\delta m/_a$ cyan) when the amounts of yellow and magenta toners are held constant is 90 units per mg/cm$^2$ of cyan toner.

Figure 4:
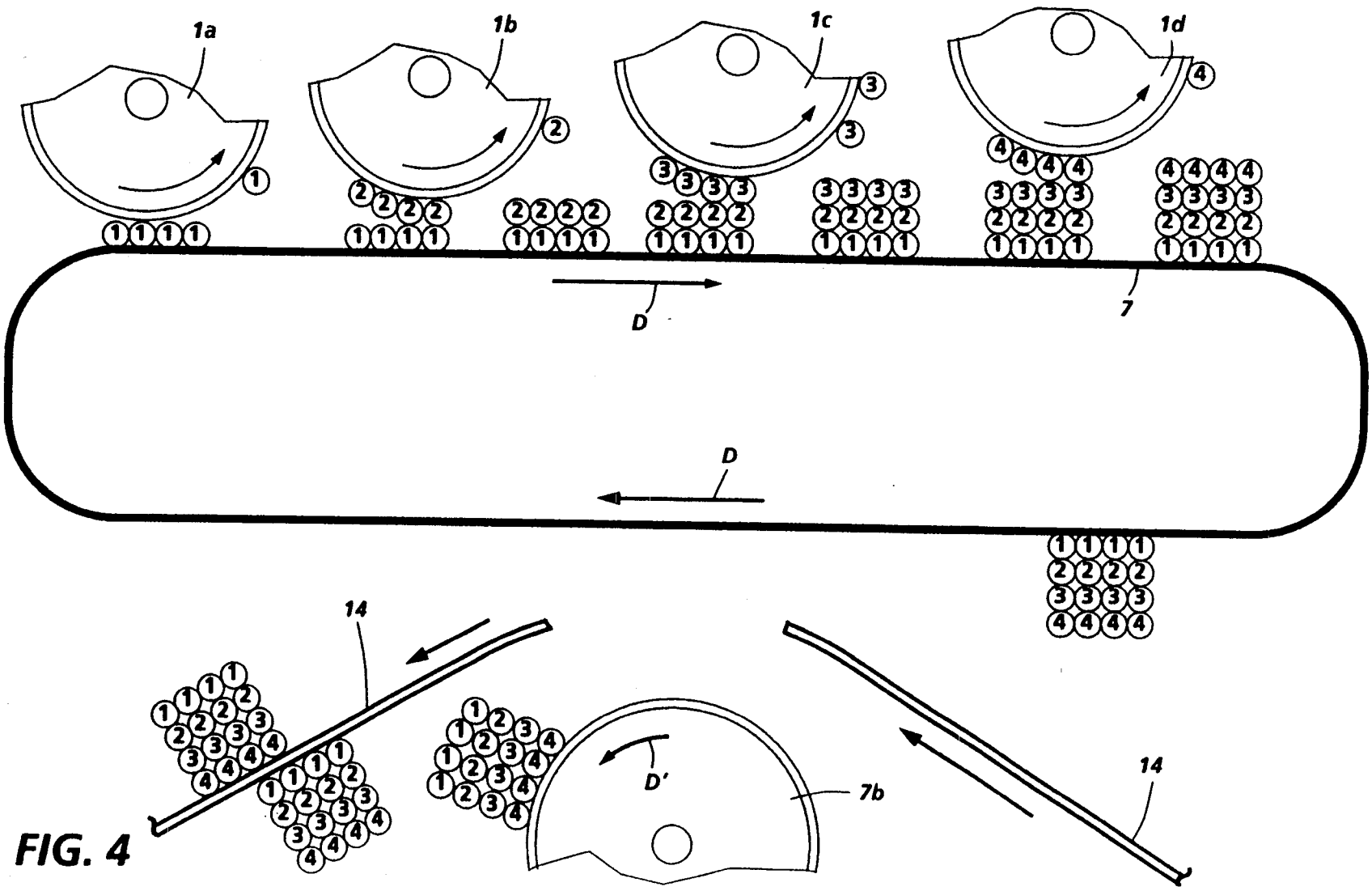
FIG. 4 shows a schematic view of the transfer system in a one pass paper duplex, color copying system.

Accordingly, it can be seen for the particular example toners, the yellow toner should be the middle layers before second transfer, as the impact of the residual loss to the full color image is greatest if it occurs for yellow. This suggests that yellow toner for this system should be deposited on the intermediate with image forming device **1*c*. Of course, the color of the toner is irrelevant, since the function is dependent on the amount of each color toner required to produce neutral gray. In accordance with another aspect of the invention, as shown in FIG. 4, in a single pass paper duplex (two sided) copying operation using multiple layers of colored toners, a first set of toner layers 1, 2, 3 and 4 is at tandem engines 1*a*, 1*b*, 1*c* and 1*d*, and transferred to the intermediate belt 7 as shown in FIG. 4 with toner #1 closest to the belt and toner #4 farthest. In this duplex arrangement, these four layers of toner will become the side I image of a duplex copy. A subsequent transfer moves the side I image to a second transfer device 7*b*. Then, a second image on intermediate belt 7 is formed with toner layers 1, 2, 3 and 4 through phasing of belt 7, such that the image on side 2 of the copy may be transferred to paper, which now comes between the photoreceptor and the side I image on intermediate 7*b*, so that transfer of toner from the photoreceptor to the paper on side 2 occurs simultaneously with transfer from the intermediate 7*b* to the paper on side 1**.

In this configuration, the layering of toners on side 1, at the time of transfer to the paper, will require that the layer closest to the intermediate belt **7*b* (#1 in FIG. 4) becomes the layer farthest from the paper. However, since side 2 is simultaneously transferred to paper, (which now is between the belts 7 and 7*b*), the layering on side 2 of the paper remains the same as it was on the intermediate 7 for side 1. Thus, referring to FIG. 2, side 1 has layer 4 closest to the paper, while side 2 has layer 1** closest to the paper. Again, to minimize the effect of the impact of variability in the residual on color stability and gray balance of the output, it is advantageous to put the toner with greatest dependence of colorimetric density on m/a in the middle of the layer.

While the inventive architecture has been described in a tandem engine context, where toner layers are created by independent imaging engines which form images on individual photoreceptors for subsequent registered transfer to an intermediate, the invention applies equally to a system providing multiple superposed, registered exposures and developed images on single photoreceptor, as described for example in U.S. Pat. No. A 4,833,503 to Snelling.

Further, while in one embodiment of the invention, the order of toner deposition is based on a position of a tandem engine or developer housing with respect to other developer housings, it will no doubt be appreciated that the invention is directed to order of deposit of toner. Accordingly, in an alternative embodiment of the invention, order of deposition may be controlled by repeated circulation of the image bearing member or intermediate past the toner depositing devices, to accomplish ordered toner deposit.

The invention has been described with reference to a particular embodiment. Modifications and alterations will occur to others upon reading and understanding this specification. It is intended that all such modifications and alterations are included insofar as they come within the scope of the appended claims or equivalents thereof.

I claim:

1. Electrophotographic imaging apparatus for forming multicolor toner images, said apparatus comprising:

first means for producing a single color toner image with a first colored toner on an image supporting surface of a first image receiving member;

second means for producing a single color toner image with a second colored toner on an image supporting surface of a second image receiving member;

third means for producing a single color toner image with a third colored toner on an image supporting surface of a third image receiving member, said first, second and third toners each being of a different color from another;

means for transferring each toner image from said image receiving members onto an intermediate image receiving member, said toner image from the first toner image producing means deposited directly on said intermediate image receiving member, and said toner from said second and third toner image producing means successively deposited superposed upon the previous toner image to form a multi layer toner image;

said second toner image producing means provided with a selected colored toner, having the characteristics that variations in mass per unit area of said toner cause a most significant color shift in an image on a final support of the first toner, second toner and third toner; and means for transferring the multi layer toner image from the intermediate image receiving member to a final support, said transfer characterized by leaving a residual amount of toner of said first toner image on said intermediate image receiving member.

2. An apparatus as defined in claim 1, wherein said first means, second means and third means each includes means to form a latent image on the image supporting surfaces thereof and means to bring one of the distinct colored toners into contact with the supporting surface.

3. An apparatus as defined in claim 1, wherein said means for transferring each toner image from each said image receiving member onto an intermediate image receiving member includes a corona generator arranged with respect to the image receiving members and the intermediate image receiving member to apply a charge to the intermediate image receiving member sufficient to electrostatically attract the toner image in imagewise configuration from the image receiving members onto an intermediate image receiving member.

4. An apparatus as defined in claim 1, wherein said means for transferring each toner image from said intermediate image receiving member to a final support includes a charging means arranged with respect to the image receiving members and the intermediate image receiving member to apply a charge to the final support sufficient to electrostatically attract the multi layer toner image in imagewise configuration from the intermediate image receiving member onto the final support.

5. Electrophotographic imaging apparatus for forming multicolor toner images, said apparatus comprising:

first means for producing a single color toner image with a first colored toner on an image supporting surfaces of a first image receiving member;

second means for producing a single color toner image with a second colored toner having a color distinct from any other toner on an image supporting surface of a second image receiving member;

third means for producing a single color toner image with a third colored toner having a color distinct from any other toner on an image supporting surface of a third image receiving member;

means for transferring each toner image from each said image receiving member onto an intermediate image receiving member, said toner image from the first toner image producing means deposited directly on said intermediate image receiving member, and said toner from said second toner image producing means and said and third toner image producing means successively deposited superposed upon the first toner image to form a multi layer toner image;

said second toner image producing means provided with a selected colored toner having the characteristic that variations in mass per unit area thereof cause a most significant color shift in an image on a final support of the first toner, second toner and third toner, wherein said selected colored toner is selected, based on requiring a least mass per unit area of the first toner, second toner and third toner in combination, to produce a neutral gray; and means for transferring the multi layer toner image from the intermediate image receiving member to a final support, said transfer characterized by leaving a residual amount of toner of said first toner image on said intermediate image receiving member.

6. Electrophotographic imaging apparatus for forming multicolor toner images, said apparatus comprising:

first means for forming a first latent image on a surface of an imaging member;

second means for forming a second latent image on the surface of the imaging member;

third means for forming a third latent image on the surface of the imaging member, said first means, second means and third latent image forming means arranged with respect to said surface and to each other to successively from a latent image on said surface;

first developer means for developing the first latent image with a first color toner, second developer means for developing the second latent image with a second color toner and third developer means for developing the third latent image with a third color toner said first developing means functionally arranged between said first latent image forming means and second latent image forming means, said second developing means functionally arranged between said second latent image forming means and third latent image forming means, and said third developer means functionally arranged after said third latent image forming means, said colored toner from the first developing means deposited directly on said surface of said imaging member, and said toner from said second developing means and third developing means successively deposited superposed upon the first toner image to form a multi layer toner image;

said second color toner having characteristic that variations in mass per unit area of said toner cause a most significant color shift in an image on a final support of the first toner, second toner and third toner; and means for transferring the multi layer toner image from the imaging member to a final support, said transfer characterized by leaving a residual amount of toner of said first toner image on said intermediate image receiving member.

7. An apparatus as defined in claim 6, wherein said means for transferring each toner image from said imaging member to a final support includes a charging means arranged with respect to the image receiving members and the imaging member to apply a charge to the final support sufficient to electrostatically attract the multi layer toner image in imagewise configuration from the imaging member onto the final support.

8. Electrophotographic imaging apparatus for forming multicolor toner images, said apparatus comprising:

first means for forming a first latent image on a surface of an imaging member;

second means for forming a second latent image on the surface of the imaging member;

third means for forming a third latent image on the surface of the imaging member, said first means, second means and third latent image forming means arranged with resect to said surface and to each other to successively form a latent image on said surface;

first developer means for developing the first latent image with a first color toner, second developer means for developing the second latent image with a second color toner and third developer means for developing the third latent image with a third color toner, said first developing means functionally arranged between said first latent image forming means and second latent image forming means, said second developing means functionally arranged between said second latent image forming means and third latent image forming means, and said third developer means functionally arranged after said third latent image forming means, said colored toner from the first developing means deposited directly on said surface of said imaging member, and said toner from said second developing means and third developing means successively deposited superposed upon the first toner image to form a multi layer toner image;

said second color toner having the characteristic that variations in mass per unit area of said toner cause the most significant color shift in an image on a final support of the colored toners used, wherein said selected color toner is selected, based on requiring a least mass per unit area of the first toner, second toner and third toner in combination, to produce a neutral gray; and means for transferring the multi layer toner image from the imaging member to a final support, said transfer characterized by leaving a residual amount of toner of said first toner image on said intermediate image receiving member.

9. Electrophotographic imaging apparatus for forming multicolor toner images, said apparatus comprising:

means for depositing at least three layers of distinct colored toners, in image configuration, in registration, on a surface of an imaging member to form a multi layered colored toner image including a first layer of toner deposited directly on the surface, a second layer of toner superposed upon the first layer, and a third layer of toner superposed upon the third layer;

said depositing means depositing as the second layer of toner a selected colored toner having the characteristic that variations in mass per unit area of said toner cause a most significant color shift in an image on a final support of the three colored toners; and means for transferring the multi layer toner image from the imaging member to a final support, said transfer characterized by leaving a residual amount of toner of said first toner image on said intermediate image receiving member.

10. A method for forming multicolor toner images with electrophotographic apparatus, in which at least three toner images are deposited on a support, in registered superposition to form a color image, the method including the steps of:

determining which toner of the at least three toners has the characteristic that variations in mass per unit area of the toner cause a most significant color shift in an image on a final support of the three colored toners;

depositing each toner image on an intermediate support in registered superposition, said toner images arranged so that the toner determined to cause the most significant color shift in an image on a final support of the three colored toners is sandwiched between at least two other toner images on the intermediate support;

transferring the multi layer toner image from the imaging member to a final support, said transfer characterized by leaving a residual amount of toner of said toner image closest to the intermediate support on said intermediate image receiving member.

* * * * *